US007922111B2

(12) United States Patent
Arvidsson

(10) Patent No.: US 7,922,111 B2
(45) Date of Patent: Apr. 12, 2011

(54) REFINING APPARATUS OF DISC-TYPE

(75) Inventor: Thomas Arvidsson, Örebro (SE)

(73) Assignee: Metso Paper, Inc. (FI)

( * ) Notice: Subject to any disclaimer, the term of this patent is extended or adjusted under 35 U.S.C. 154(b) by 142 days.

(21) Appl. No.: 11/922,498

(22) PCT Filed: Jun. 7, 2006

(86) PCT No.: PCT/SE2006/050185

§ 371 (c)(1),
(2), (4) Date: Apr. 7, 2009

(87) PCT Pub. No.: WO2006/137801

PCT Pub. Date: Dec. 28, 2006

(65) Prior Publication Data

US 2010/0019076 A1 Jan. 28, 2010

(30) Foreign Application Priority Data

Jun. 20, 2005 (SE) ..... 0501401

(51) Int. Cl.
*B02C 7/14* (2006.01)

(52) U.S. Cl. ..... 241/261.2

(58) Field of Classification Search ..... 241/37, 241/286, 261.2, 261.3, 296–298
See application file for complete search history.

(56) References Cited

U.S. PATENT DOCUMENTS

| | | | | |
|---|---|---|---|---|
| 4,039,152 | A | | 8/1977 | Peterson |
| 4,039,153 | A | | 8/1977 | Hoffman |
| 4,378,092 | A | * | 3/1983 | Reinhall ..... 241/16 |
| 4,627,578 | A | | 12/1986 | Whyte |
| 5,067,660 | A | | 11/1991 | Reinhall |
| 5,323,972 | A | | 6/1994 | Kjellqvist |

FOREIGN PATENT DOCUMENTS

DE 2 116 146 A 10/1972

* cited by examiner

*Primary Examiner* — Mark Rosenbaum
(74) *Attorney, Agent, or Firm* — Lerner, David, Littenberg, Krumholz & Mentlik, LLP

(57) ABSTRACT

A disc refiner is disclosed, including a shaft, a rotatable disc and a stationary disc, both with refiner elements. Between the stationary refiner elements and the stationary disc, axially deformable chambers are arranged, filled with an incompressible hydraulic medium, whereby the stationary refiner elements can move angularly in order to adjust themselves tangentially in parallel to the refiner elements of the rotatable disc, and the incompressibility of the hydraulic medium prevents stationary refiner elements from moving axially and impairing the axial stiffness.

14 Claims, 6 Drawing Sheets

REFINING APPARATUS OF DISC-TYPE

FIELD OF THE INVENTION

The present invention relates to a refining apparatus of the disc-type, consisting of a disc rotatable by a shaft and a stationary disc as well as sets of refiner elements provided between them.

BACKGROUND OF THE INVENTION

Within the cellulose technology, apparatuses of the above-mentioned description are frequently found, where the material intended for refining is supplied through an opening in the stationary disc and is refined between the set of stationary and the set of rotary refiner elements.

Here, the amount and intensity of the refining work may be said to be controlled by the rotational speed and diameter of the rotary disc, as well as the predetermined distance between the sets of refiner elements, the so-called disc gap. Since a standard-sized refining apparatus of today may have a disc diameter of about 1700 mm, and can generate about 15 MW, a resulting refining force, i.e., the axial tie force needed to sustain a given disc gap, corresponding to 80 kN or more, may be required.

The size of the disc gap, dependent on the process, starting material and desired fiber quality, may vary between about 0.2 and 1.0 mm. Irrespective of the nominal size of the disc gap, it is, however, of utmost importance in terms of or the refining result that the size of the disc gap be is constant, in spite of fast variations in the flow of refining material.

In recent years, the trend within this field of cellulose technology has been toward finer paper qualities, which means more refining work, which in turn has required larger disc diameters, greater rotational speeds, and above all smaller disc gaps. This has thus elucidated another important area, the parallelism between the sets of refiner elements, i.e. the deviation of the disc gap around the periphery of the disc.

Previously, a deviation of about 0.05 mm has frequently been accepted as a rule of thumb, but with a decreasing nominal disc gap, down to about 0.2 to 0.3 mm, and this has become increasingly difficult to accept. Furthermore, the larger diameters have made it more difficult to adjust the machine to such precision. This adjustment has, moreover, to be carried out with the machine not running in a cool state. The thermal expansion which occurs during operation naturally involves additional deviations, since the trend is also toward higher process pressures, and thus higher temperatures. Simultaneously, greater demands have also been made on the stiffness of the machine, i.e., the size of the disc gap must not vary too much with the refining force.

One of the objects of the present invention is to provide a refining apparatus which has the set of refiner elements of the stationary disc self-adjusting parallelism-wise in relation to the set of refiner elements of the rotatable disc, without the axial stiffness of the machine being appreciably impaired.

SUMMARY OF THE INVENTION

In accordance with the present invention, these and other objects have now been realized by the invention of a disc refiner comprising a rotatable shaft, a rotatable disc mounted on the rotatable shaft including a first refining face, a stationary disc including a second refining face juxtaposed with the rotatable disc thereby defining a refining space between the first and second refining faces, first and second refiner elements mounted on the first and second refining faces, and at least one axially deformable hydraulic chamber acting between the stationary disc and the second refiner elements whereby the second refiner elements can adjust tangentially during operation of the disc refiner to maintain parallelism between the first and second refiner elements while retaining the axial stiffness thereof. Preferably, the at last one axially deformable hydraulic chamber includes a constant volume of a substantially incompressible hydraulic medium.

In accordance with a preferred embodiment of the disc refiner of the present invention, the disc refiner includes a refiner element holder mounted between the stationary disc and the second refiner elements, the at least one axially deformable hydraulic chamber being disposed in the refiner element holder. Preferably, the refiner element holder is fixed to the stationary disc at the inner periphery thereof, and the at least one axially deformable hydraulic chamber is located at the outer periphery thereof. In another embodiment, the disc refiner includes a piston, and the at least one axially deformable hydraulic chamber is defined by the refiner element holder and the piston sealingly attached to the refiner element holder.

In accordance with another embodiment of the disc refiner of the present invention, the at least one axially deformable hydraulic chamber is integral with the refiner element holder, whereby the deformation of the axially deformable hydraulic chamber is carried out directly by the material constituting the refiner element holder. In a preferred embodiment, the refiner element holder comprises a membrane, whereby the deformation of the at least one axially deformable hydraulic chamber is carried out by the material constituting the membrane.

In accordance with another embodiment of the disc refiner of the present invention, the at least one axially deformable hydraulic chamber comprises a plurality of circular chambers and a corresponding plurality of ducts connecting the plurality of circular chambers. Preferably the disc refiner includes a plurality of flow throttles corresponding to the plurality of ducts for decreasing the mobility of the hydraulic medium therein.

In accordance with another embodiment of the disc refiner of the present invention, the amount of the hydraulic medium contained within the at least one axially deformable hydraulic chamber can be altered to provide for continuous adjustment between the first and second refiner elements.

In accordance with another embodiment of the present invention, the disc refiner includes a plurality of the axially deformable hydraulic chambers and a corresponding plurality of ducts connecting the plurality of axially deformable hydraulic chambers, the plurality of axially deformable hydraulic chambers being disposed on the side of the stationary disc opposite from the second refining face, and including a plurality of pressure rods for activating the refiner element holder. In a preferred embodiment, the disc refiner includes attachment means for attaching the refiner element holder to the stationary disc at the inner periphery thereof, and the plurality of axially deformable hydraulic chambers are attached to the stationary disc at the outer periphery thereof. Preferably, the disc refiner includes a plurality of flow throttles corresponding to the plurality of ducts for decreasing the mobility of the hydraulic medium therein. In a preferred embodiment, the amount of the hydraulic medium contained within the plurality of axially deformable hydraulic chambers can be altered to provide for continuous adjustment between the first and second refiner elements.

According to the features of the present invention, the above objects are attained by there being arranged between the stationary disc and the refiner elements thereof one or more axially deformable chambers, preferably containing a constant volume of incompressible hydraulic medium. It should be noted that the chamber or chambers do not necessarily need to be physically positioned between the stationary disc and the refiner elements. They may, e.g., act by means of piston rods to the external cylinders on the other the side of the stationary disc.

The deformable chambers allow the set of refiner elements of the stationary disc to move angularly but, owing to the constant volume of hydraulic medium of the chamber, not axially.

BRIEF DESCRIPTION OF THE DRAWINGS

The present invention may be more fully appreciated with reference to the following detailed description, which in turn refers to the figures in which.

DETAILED DESCRIPTION

Figure 1:
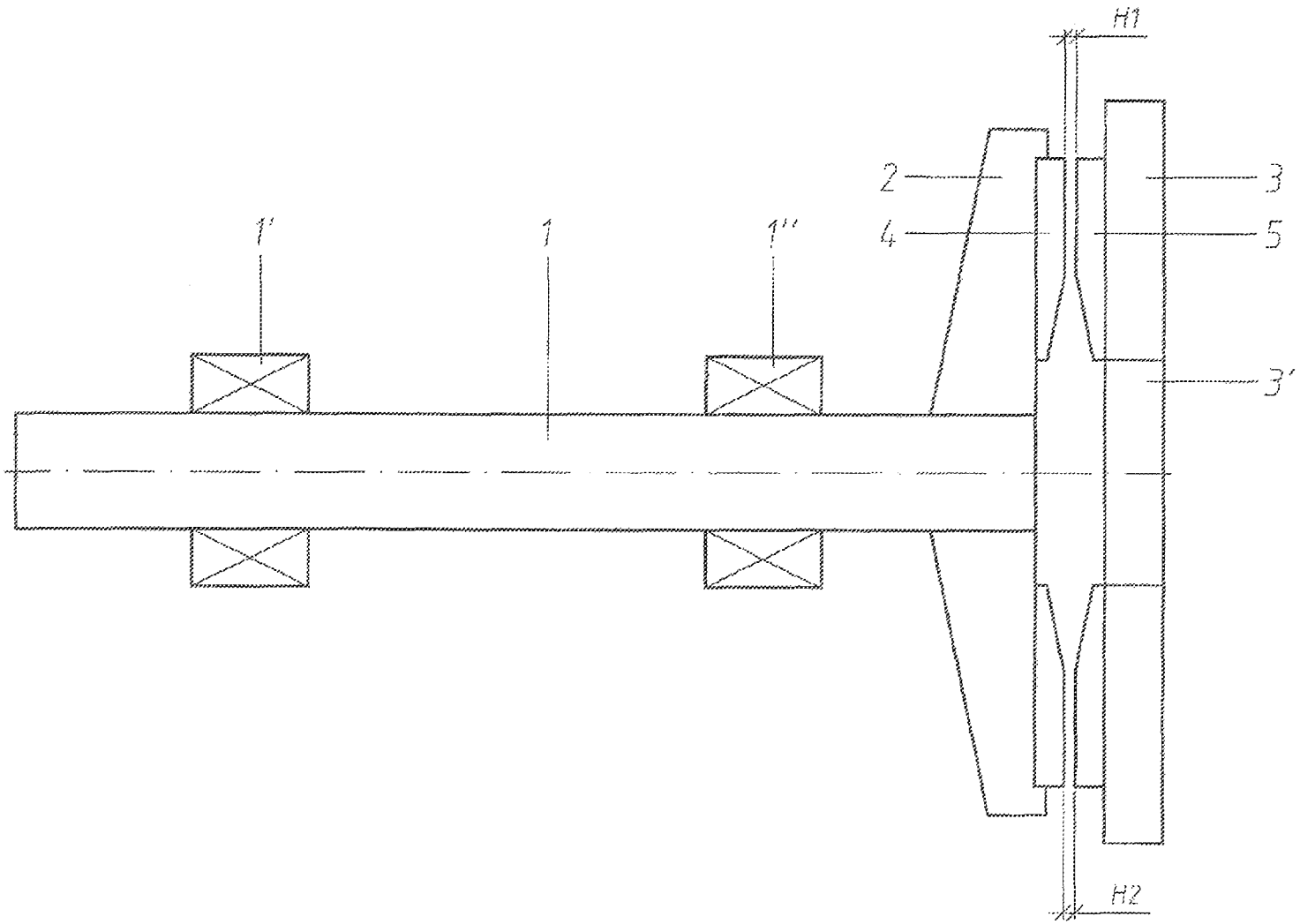
FIG. 1 PRIOR ART
FIG. 1 is a side, elevational, partially schematic view of a refining apparatus in accordance with the prior art.

Referring to the figures, FIG. 1 shows a refining apparatus of the prior art. The rotatable shaft 1 is mounted in the bearings, 1' and 1", as well as fixedly connected to the disc 2. The stationary disc 3 has an opening 3' for the supply of refinable material. The refiner elements, 4 and 5, are connected to the rotatable disc and the stationary disc, respectively, and arranged at a given distance, disc gaps, H1 and H2, to each other. H1 and H2 intend to indicate deviation of parallelism between the two sets of refiner elements.

Figure 2:
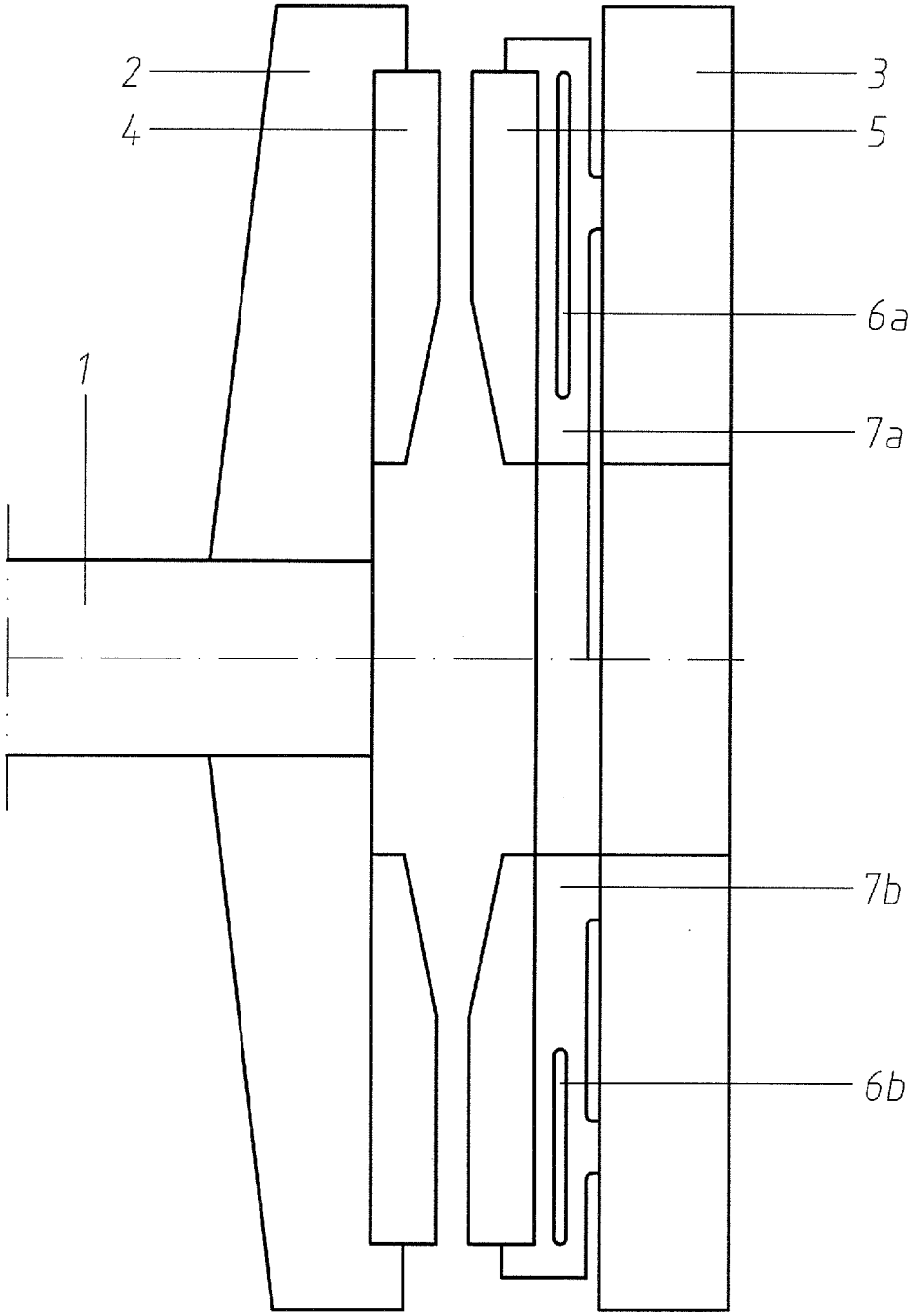
FIG. 2 is a side, elevational, partial schematic view of a refining apparatus in accordance to the present invention.

FIG. 2 shows the essential parts of a refining apparatus according to the present invention.

The rotary disc 2 including the refiner elements 4 thereof is of a known type, while the stationary disc 3 has been equipped with a refiner element holder 7*a* and 7*b*, respectively, intended for the refiner elements 5, which holder contains the axially deformable chamber 6*a* and 6*b*, respectively. Above the center line in the figure, a chamber 6*a* is shown that extends from the inner periphery of the refiner element holder 7*a* to the outer periphery thereof. Below the center line, a variant is shown where the holder 7*b* is fixedly clamped to the stationary disc at the inner periphery thereof and has the deformable chamber 6*b* at the outer periphery thereof.

By adapting the amount of hydraulic medium in the chambers, the latter embodiment of the present invention also allows, if required, to adjust the radial parallelism of the set of stationary refiner elements in relation to the set of rotary refiner elements.

In both of these embodiments shown in FIG. 2, the annular chamber 6 is filled with a constant amount of hydraulic medium, which can move within the chamber to allow the set of refiner elements 5 to be moveable angularly in order to adjust itself in parallel to the set of refiner elements 4 of the rotatable disc. Simultaneously, the incompressibility of the hydraulic medium prevents the set of refiner elements 5 from moving in a purely axial direction and thereby impairing the axial stiffness of the machine.

Figure 3:
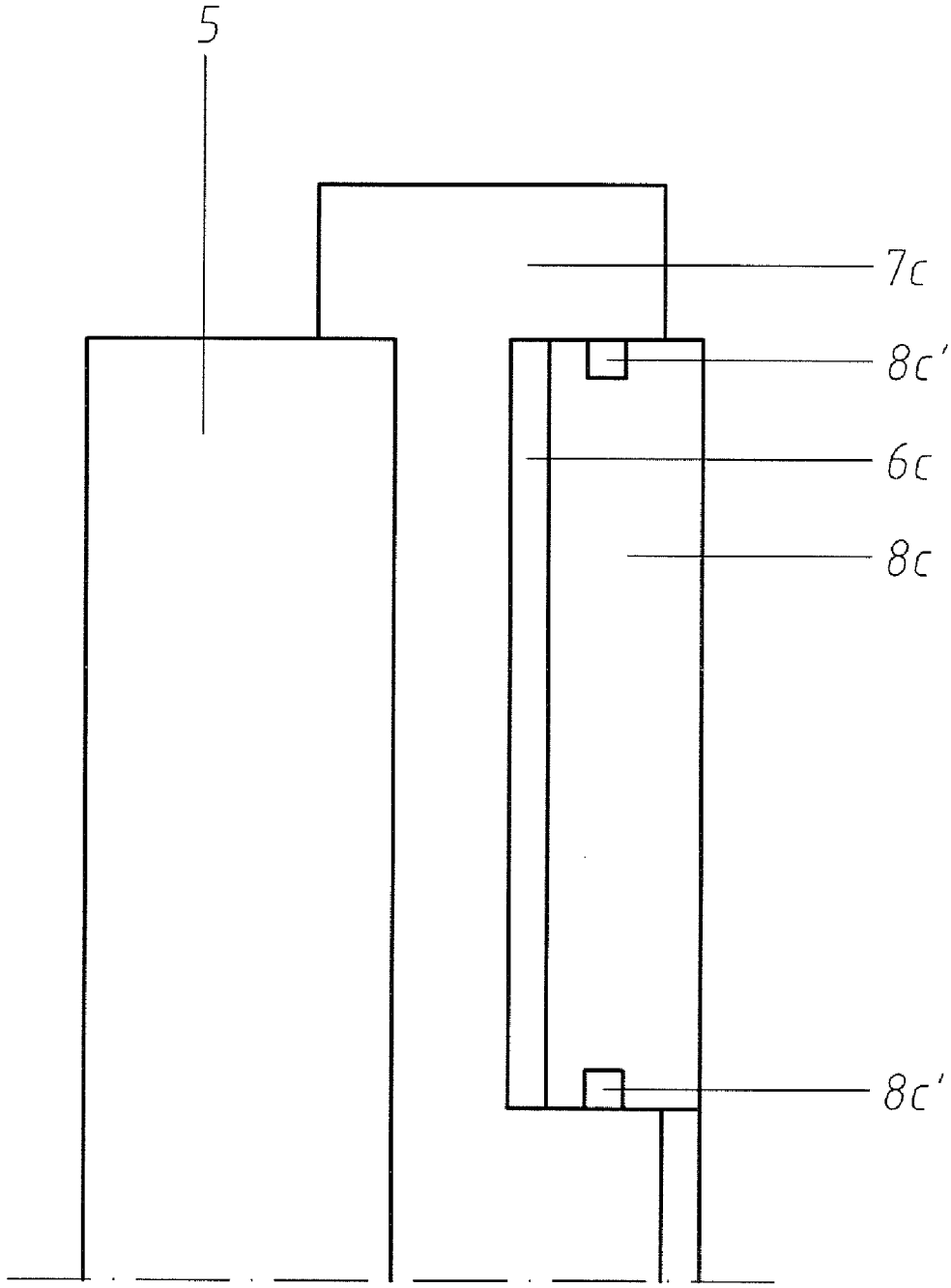
FIG. 3 is a side, elevational, partial schematic representation of a portion of a refining apparatus in accordance with the present invention.

FIG. 3 shows a way to construct the deformable chamber 6*c*. An annular piston 8*c* is sealed using, e.g., O-rings 8*c'* against the surrounding refiner element holder 7*c*, which serves as a cylinder.

Figure 4:
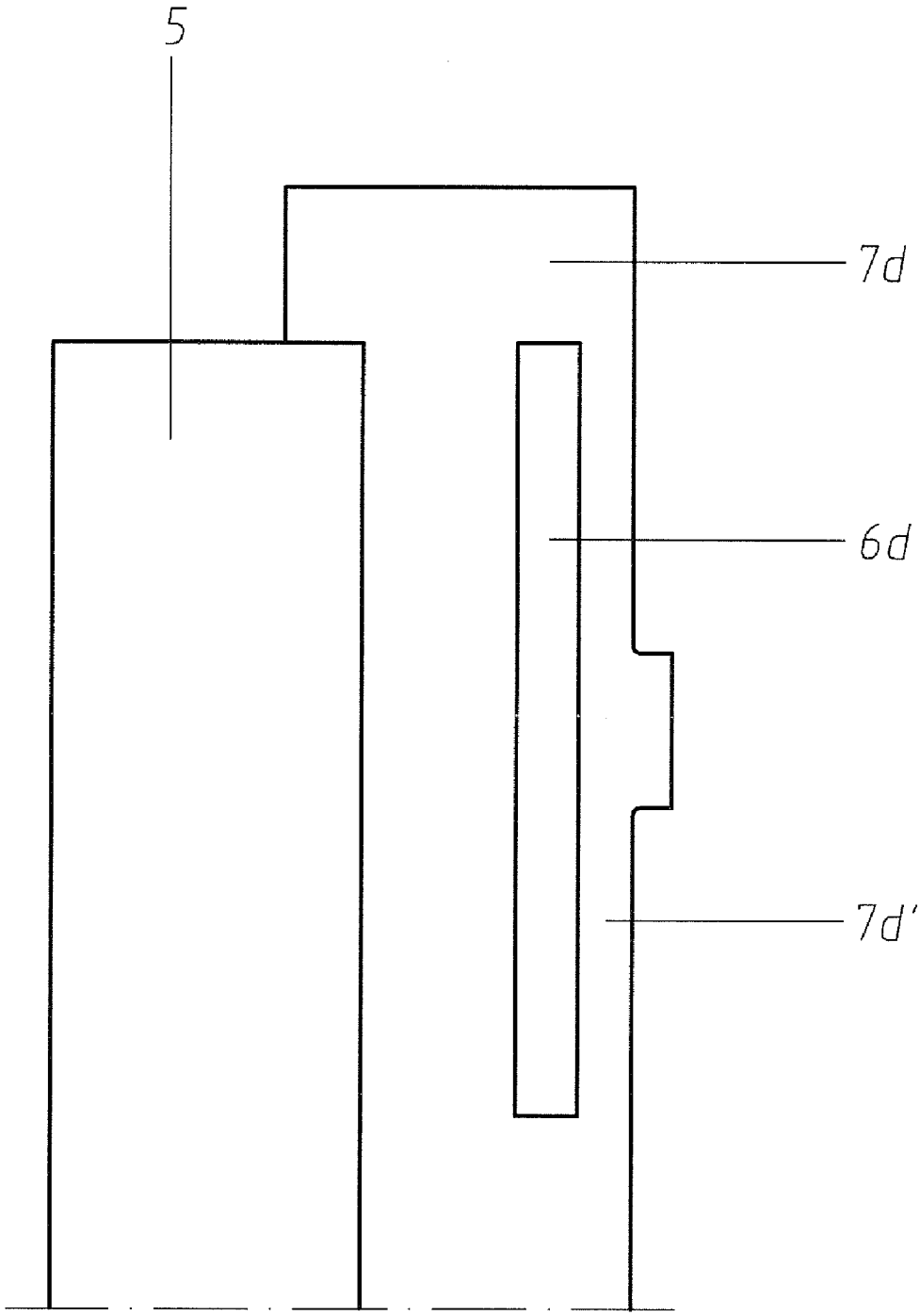
FIG. 4 is a side, elevational, partial schematic representation of a portion of another refining apparatus in accordance with the present invention.

FIG. 4 shows a variant of the present invention where the chamber 6*d* is entirely integrally integrated in the holder 7*d*. Sufficient deformation for the purpose is then carried directly by the holder material, like a membrane, 7*d'*.

Figure 5:
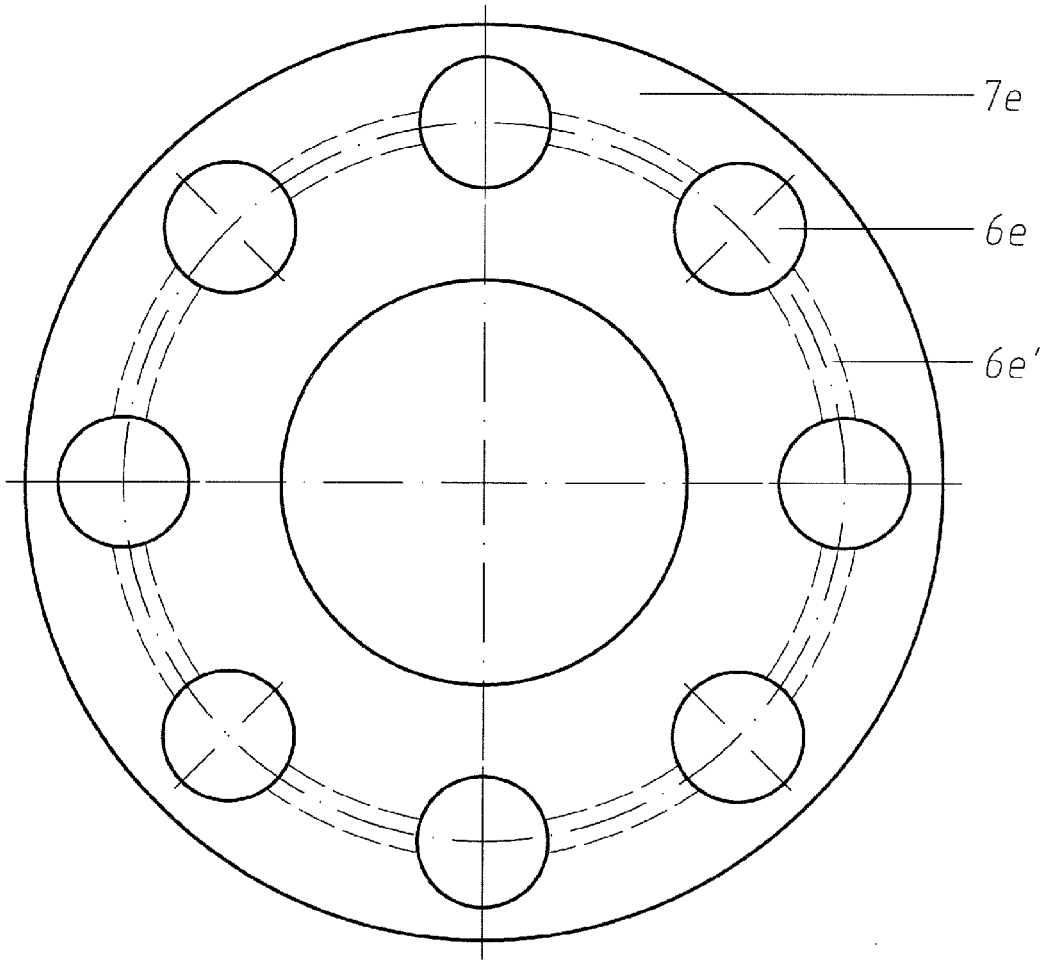
FIG. 5 is a front, elevational, partial schematic view of a portion of the refiner element in accordance with the present invention.

FIG. 5 shows the annular chamber formed as a number of separate, circular chambers 6*e* connected by the ducts 6*e'*. This method allows flow throttles to be provided between the chambers in order to counteract possible vibrations, e.g., upon uneven supply.

Figure 6:
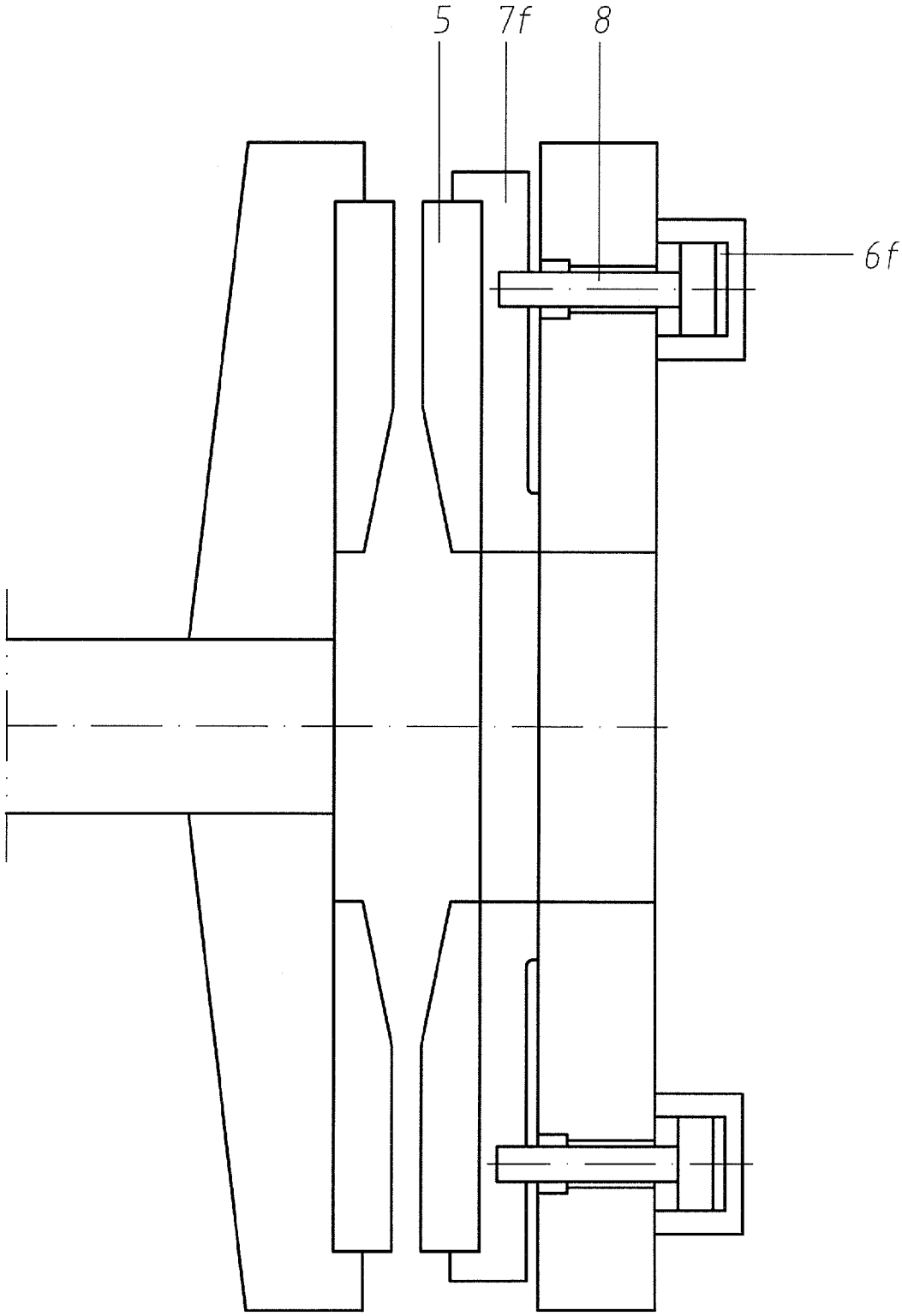
FIG. 6 is a side, partial, elevationl view of a portion of another refiner element in accordance with the present invention.

FIG. 6 shows an embodiment of the present invention where the refiner element holder is fixedly clamped at the inner periphery thereof and the deformable chambers provided as external cylinders 6*f* on the other side of the stationary disc 3, as seen from the refiner elements 5 thereof, arranged to actuate the refiner element holder 7*f* by means of piston rods 8.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A disc refiner comprising a rotatable shaft, a rotatable disc mounted on said rotatable shaft including a first refining face, a stationary disc including a second refining face juxtaposed with said rotatable disc thereby defining a refining space between said first and second refining faces, first and second refiner elements mounted on said first and second refining faces, and at least one axially deformable hydraulic chamber acting between said stationary disc and said second refiner elements whereby said second refiner elements can adjust tangentially during operation of said disc refiner to maintain parallelism between said first and second refiner elements while retaining the axial stiffness thereof.

2. The disc refiner of claim 1 wherein said at last one axially deformable hydraulic chamber includes a constant volume of a substantially incompressible hydraulic medium.

3. The disc refiner of claim 2 including a refiner element holder mounted between said stationary disc and said second refiner elements, said at least one axially deformable hydraulic chamber being disposed in said refiner element holder.

4. The disc refiner of claim 3 wherein said refiner element holder is fixed to said stationary disc at the inner periphery thereof, and said at least one axially deformable hydraulic chamber is located at the outer periphery thereof.

5. The disc refiner of claim 3 including a piston, and wherein said at least one axially deformable hydraulic chamber is defined by said refiner element holder and said piston sealingly attached to said refiner element holder.

6. The disc refiner of claim 3 wherein said at least one axially deformable hydraulic chamber is integral with said refiner element holder, whereby said deformation of said axially deformable hydraulic chamber is carried out directly by the material constituting said refiner element holder.

7. The disc refiner of claim 6 wherein said refiner element holder comprises a membrane, whereby said deformation of said at least one axially deformable hydraulic chamber is carried out by the material constituting said membrane.

8. The disc refiner of claim 5 wherein said at least one axially deformable hydraulic chamber comprises a plurality of circular chambers and a corresponding plurality of ducts connecting said plurality of circular chambers.

9. The disc refiner of claim 8 including a plurality of flow throttles corresponding to said plurality of ducts for decreasing the mobility of said hydraulic medium therein.

10. The disc refiner of claim 2 wherein the amount of said hydraulic medium contained within said at least one axially deformable hydraulic chamber can be altered to provide for continuous adjustment between said first and second refiner elements.

11. The disc refiner of claim 3 including a plurality of said axially deformable hydraulic chambers and a corresponding plurality of ducts connecting said plurality of axially deformable hydraulic chambers, said plurality of axially deformable hydraulic chambers being disposed on the side of said stationary disc opposite from said second refining face, and including a plurality of pressure rods for activating said refiner element holder.

12. The disc refiner of claim 11 including attachment means for attaching said refiner element holder to said stationary disc at the inner periphery thereof, and wherein said plurality of axially deformable hydraulic chambers are attached to said stationary disc at the outer periphery thereof.

13. The disc refiner of claim 12 including a plurality of flow throttles corresponding to said plurality of ducts for decreasing the mobility of said hydraulic medium therein.

14. The disc refiner of claim 13 wherein the amount of said hydraulic medium contained within said plurality of axially deformable hydraulic chambers can be altered to provide for continuous adjustment between said first and second refiner elements.

* * * * *